US006141803A

United States Patent [19]

Dunphy et al.

[11] Patent Number: 6,141,803

[45] **Date of Patent: *Nov. 7, 2000**

[54] FLOOR PROTECTION AND CLEANING IN MALE TOILETS

[75] Inventors: Thomas Austin Dunphy; Robert L Morton, both of Dublin, Ireland

[73] Assignee: Aqua Deck Limited, Ireland

[ * ] Notice: This patent issued on a continued prosecution application filed under 37 CFR 1.53(d), and is subject to the twenty year patent term provisions of 35 U.S.C. 154(a)(2).

[21] Appl. No.: 08/952,323

[22] PCT Filed: Apr. 26, 1996

[86] PCT No.: PCT/IE96/00025

§ 371 Date: Oct. 27, 1997

§ 102(e) Date: Oct. 27, 1997

[87] PCT Pub. No.: WO96/34157

PCT Pub. Date: Oct. 31, 1996

[30] Foreign Application Priority Data

Apr. 26, 1995 [IE] Ireland ..... S950296

[51] Int. Cl.[7] ..... E03D 13/00

[52] U.S. Cl. ..... 4/310; 4/301

[58] Field of Search ..... 4/301, 302, 303, 4/310, 311

[56] References Cited

U.S. PATENT DOCUMENTS

| | | | |
|---|---|---|---|
| 358,651 | 3/1887 | Clifford | 4/310 |
| 963,472 | 7/1910 | Rowell | 4/310 |

FOREIGN PATENT DOCUMENTS

| | | | |
|---|---|---|---|
| 242377 | 1/1912 | Germany . | |
| 10513 | 7/1887 | United Kingdom | 4/311 |
| 19664 | 11/1890 | United Kingdom | 4/311 |
| 21394 | 7/1898 | United Kingdom | 4/310 |
| 17401 | 9/1911 | United Kingdom . | |
| 1634 | 11/1914 | United Kingdom . | |
| 1353504 | 5/1974 | United Kingdom . | |

*Primary Examiner*—Robert M. Fetsuga
*Attorney, Agent, or Firm*—Parkhurst & Wendel, L.L.P.

[57] ABSTRACT

A washable floor for a urinal consists of a metal grid (10) through which fluid may pass downwardly and an inclined sub-floor (6) on which the fluid falls. A flushing system flushes the inclined sub-floor (6) towards the urinal. This greatly reduces odors.

15 Claims, 6 Drawing Sheets

FLOOR PROTECTION AND CLEANING IN MALE TOILETS

FIELD OF THE INVENTION

The present invention is in the field of floor protection and cleaning in male toilets.

A common problem in male toilets the world over is that of soiled floors, especially in the area around urinal stalls. Frequent cleaning is required to prevent the floors from becoming unhygienic, unsightly and unaesthetic. Such cleaning is expensive in labour costs and does not totally solve the problem. The action of uric acid on many of the more commonly used floor finishes results in unsightly discolouration within a short period of time and the eventual breaking down of the flooring materials necessitating their replacement at fairly frequent intervals. This is both expensive and disruptive.

PRIOR ART—GB-A-1,353,504

GB-A-1,353,504 in the name Regency Stainless Limited relates to urinals of the kind comprising a back wall which merges at the bottom into a trough fitted with a waste outlet, a sparge arrangement being provided at or near the top of the back wall to enable flushing water to be supplied to the front face of this wall and thence to the trough.

The patent teaches that in earlier constructions of urinals of this type, the trough is relatively narrow and a solid platform, on which users stand, is arranged immediately in front of it.

The patent teaches that such earlier constructions suffer from the drawback that the platform frequently becomes wet with spillage which can then be carried by the shoes of the users on to the floor area of the room in which the urinal is installed, thus giving rise to the creation of unhygienic conditions as well as to possible damage to floor coverings.

The patent teaches that a further drawback that arises with the known constructions is that the presence of the projecting platform, especially when this is made in one piece with the trough as is usually the case, frequently gives rise to difficulties in reaching the waste outlet for the purpose of coupling a waste pipe to it during installation of the urinal.

The patent then discloses a urinal which comprises a back wall, two side walls projecting forwardly from the ends of the back wall, a trough extending between the bottom parts of the side walls and projecting forwardly from the bottom part of the back wall, the trough having a base and an upwardly projecting front wall portion, a waste outlet formed in the base of the trough and positioned adjacent to the front wall portion thereof, a sparge device arranged at or near the top of the back wall and through which flushing water may be supplied to the front face of the back wall and thence to the interior of the trough, and an openwork, grating to enable a user of the urinal to freely stand thereon and which extends over the front part of the trough and is spaced above the base thereof, the grating being of such width when measured between its front and rear edges, compared with the width of the trough when measured in the same direction, that an uninterrupted opening is left between the rear edge of the grating and the front face of the back wall of the urinal.

The patent then describes and illustrates two embodiments which are substantially similar, differing only in the manner in which the grating is mounted over the trough. In both embodiments the floor of the trough is inclined downwardly in the direction away from the back wall and the flushing system consists of water flowing down the front face of the back wall and continuing down the inclined trough and draining out through a drain hole located at the front of and to one side of the trough beneath the grating. In both embodiments the floor of the trough is also inclined from side to side, sloping downwardly towards that side where the drain hole is located.

The arrangement described above suffers from a significant disadvantage. All of the urine, including that which has been correctly directed at the urinal back wall, is swept along the floor of the trough beneath the person standing on the grating. It will be apparent that this may give rise to strong odours.

A further disadvantage is that the greater the area of the trough and the grating, the greater the odour. Conversely, the smaller the area of the trough and grating, the smaller the advantage afforded in terms of a clean floor. Compromise between these competing disadvantages is necessary. In the described embodiments the grating extends only a short distance from front-to back.

The arrangement described above suffers from a further disadvantage in that the side-to-side inclination in combination with the front to back inclination may result in a substantially diagonal flow of the flushing water from the uppermost corner of the floor of the trough to the lowermost corner so that the region of the sub-floor to one side of this diagonal and higher than this diagonal may never be properly flushed.

OTHER PRIOR ART

The prior art also includes a urinal as described above but with the trough having a planar horizontal floor. This male toilet suffers from the first two disadvantages mentioned above.

The prior art also includes a room in which urinals are located, the room having a floor of generally conventional construction but having a number of small areas which are of different construction. The areas are those on which a man is likely to stand when making use of a wall mounted urinal pan or a wall mounted wash hand basin, and are spaced apart from the wall. The different construction consists of a pit incorporated into the floor and covered by a grid the top of which is co-planar with the surface of the floor. The floor of the pit lies in a horizontal plane. Fluid may pass downwardly through the grid into the pit which is then flushed from time to time. The advantage of this arrangement is that when standing on the grid the man has the sensation of standing on a firm dry floor. However, the floor overall and particularly in the region between the area of different construction and the wall on which the pan is mounted suffers from all of the above mentioned disadvantages.

OBJECT OF THE INVENTION

The object of the invention is to provide a floor or floor element in which the problems mentioned above are reduced or eliminated and which is thus suitable for use in a male toilet.

STATEMENTS OF THE INVENTION AND ADVANTAGES

The invention provides a floor for the vicinity of a urinal comprising:

(a) a grid or mesh or array on which a person may stand but through which fluid may pass downwardly;

(b) a sub-floor onto which the fluid falls;

(c) mounting means for mounting the grid above the sub-floor;

(d) flushing means for flushing the sub-floor; and (e) a drain outlet for draining the sub-floor, characterised in that (f) the floor element extends as far as the urinal;

(g) the sub-floor is inclined downwardly towards the urinal;

(h) the flushing means flushes down the inclined sub-floor towards the urinal; and i) the drain outlet is at the lower edge of the inclined sub-floor.

The provision of a downward slope towards the urinal substantially overcomes the problems of the prior art. Only misdirected urine is washed along the sub-floor, thus substantially reducing the odour problem. There is also no limitation on the extent of the grid and sub-floor in the direction away from the urinal. A greater extent provides a greater flushed area and a more hygienic floor.

Preferably the grid is pivotally movable between a horizontal operational position and a non-horizontal, preferably vertical, position and/or is removable to facilitate maintenance and/or washing.

Preferably the flushing means consists of a channel or pipe or fitting incorporated into the structure and extending along part or all of the perimeter of the sub-floor and provided with a plurality of ports for delivering water to the sub-floor.

Preferably the grid comprises essentially an array of parallel members extending towards the urinal.

The invention also provides a floor as aforesaid in combination with a urinal back wall located at and extending parallel to the lower edge of the sub-floor and including a further flushing mechanism for flushing the back wall downwardly towards the lower edge of the sub-floor.

The invention also provides a floor as aforesaid in combination with a urinal pan mounted above the lower edge of the sub-floor and including a further flushing mechanism for flushing the pan downwardly towards the lower edge of the sub-floor.

Preferably the floor and urinal have a common drain outlet. Preferably the common drain outlet is located in a drainage channel located at and extending parallel to the lower edge of the inclined sub-floor.

Preferably the drainage channel is inclined towards the drain outlet.

The floor or combination according to the invention may be provided in the form of modules which may be joined together to form a unit.

BRIEF DESCRIPTION OF THE DRAWINGS

The invention will now be described with reference to the accompanying drawings which show, by way of non-limiting example only, two constructions of urinal channel, sub-floor and grid according to the invention. In the drawings.

DETAILED DESCRIPTION OF THE PREFERRED BUT NON-LIMITING EMBODIMENTS

Figure 1:
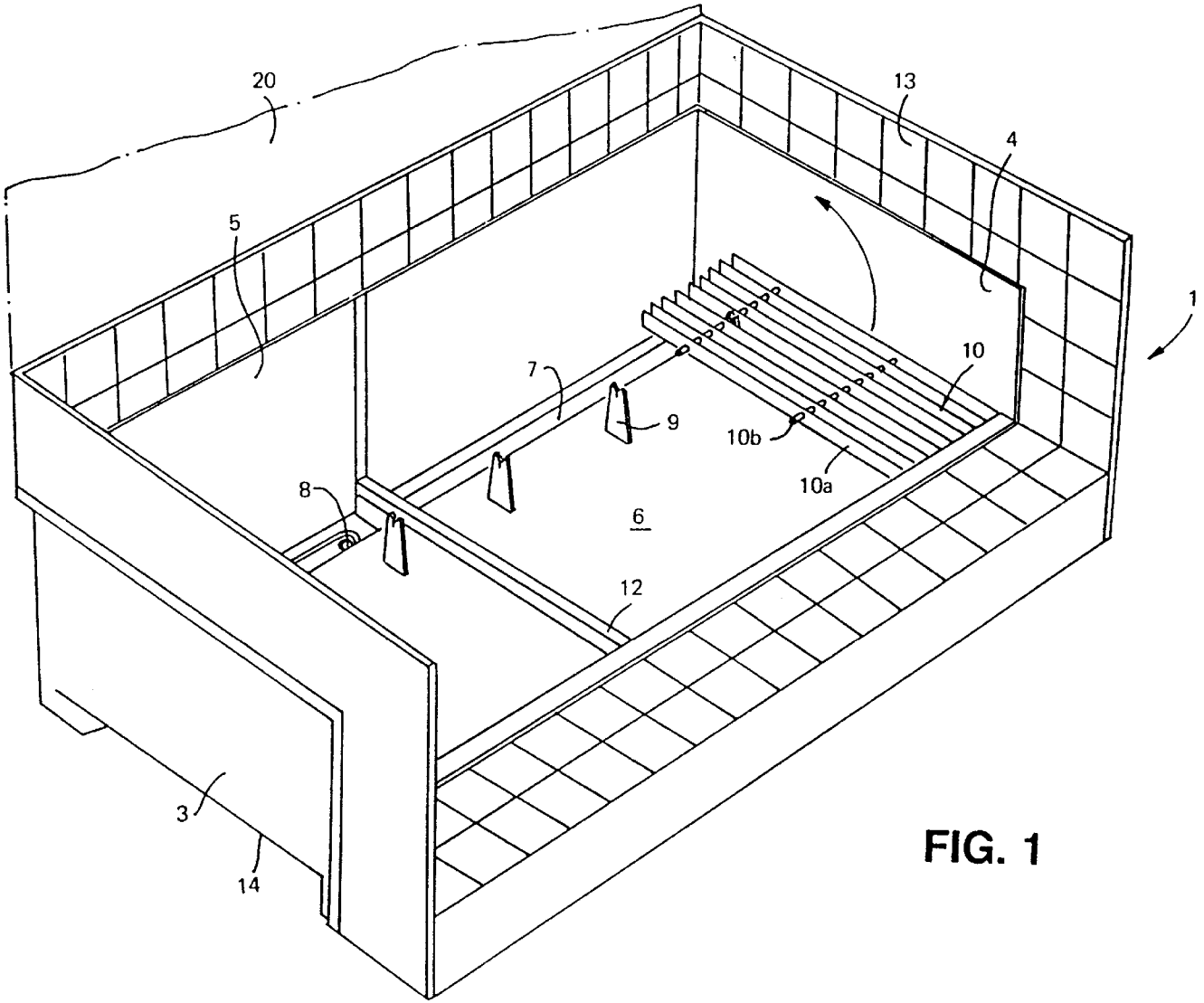
FIG. 1 is a perspective view of a urinal channel, sub-floor and grid according to the invention for installation in a new building.

Referring initially to FIGS. 1 to 4, a combined urinal channel and floor for a urinal is generally designated 1. The floor element is located directly in front of the urinal channel, the region most susceptible to the various problems mentioned above. The remainder of the floor in the room (not shown) may be of conventional construction and finish. The combination urinal channel, sub-floor and floor comprises a left hand side wall 3, a right hand side wall 4, facing wall 5, a sub-floor 6 which is at a lower level than the floor of the room and which slopes towards the facing wall 5, a urinal channel 7 along the base of the facing wall 5, gulley trap 8 in the channel 7, mounting stanchions 9, and a metal grid 10 (shown partly cut away) which is mounted on the mounting stanchions 9 and on a ledge 11 (see FIGS. 2 to 4).

Suitable plumbing connections (not shown) are provided for supply of fresh water and removal of sewage.

In use, the user stands on the metal grid 10, facing the facing wall 5, and urinates. A urinal wall 20 (shown in dashed lines) is directly above the urinal channel facing wall 5 and flushed in the conventional manner by water from an upper pipe or fitting (not shown). In addition, in accordance with the invention, the sub-floor 6 is flushed along the downward slope towards the channel 7 and out through the gulley trap 8. In this way the urinal, urinal channel, and floor are kept in generally clean condition.

From time to time, the metal grid 10 may also be cleaned. The metal grid 10 is hosed down. The water from the hosing operation drains down onto the sub-floor 6. It will be particularly noted that the metal grid 10 consists essentially of parallel slats or members 10*a*, joined by small diameter transverse rods 10*b*. This arrangement can be easily cleaned by brushing with a brushing action parallel to members 10*a*.

It will be seen that the metal grid 10 is pivotally mounted on the mounting pillars 9. The combined urinal channel and floor may be more comprehensively cleaned by pivoting the front edge of the metal grid 10 upwardly as shown both by FIG. 8 and by the arrow in FIG. 1, a pole and hook (not shown) are used for this purpose, or by removing the metal grid 10.

Other features illustrated in FIGS. 1 to 4 and 7 include a joint 12 for joining two modules on site to form a unit, a bottom panel 14, and a transverse channel shaped support strut 15 to support the mounting stanchions 9. Also shown is a tiled surround 13 but this is provided only if a vitreous china urinal pan (not shown) is used, rather than the alternative of a stainless steel wall urinal 20. Both vitreous china pans and the stainless steel wall urinals 20 will be provided with their own flushing systems.

Figure 2:
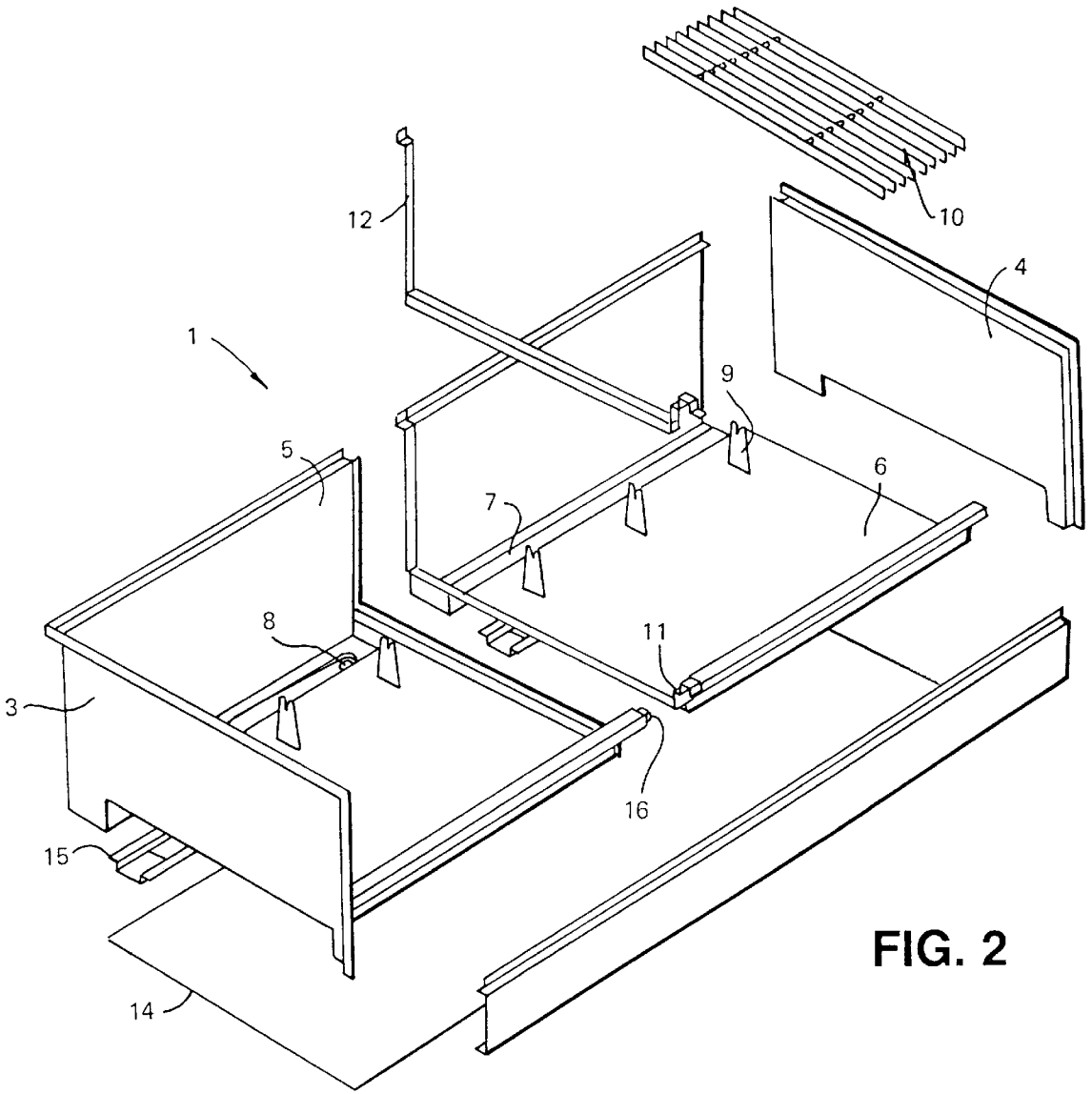
FIG. 2 is an exploded perspective view of the urinal channel, sub-floor and grid of FIG. 1 showing its component parts.
Figure 3:
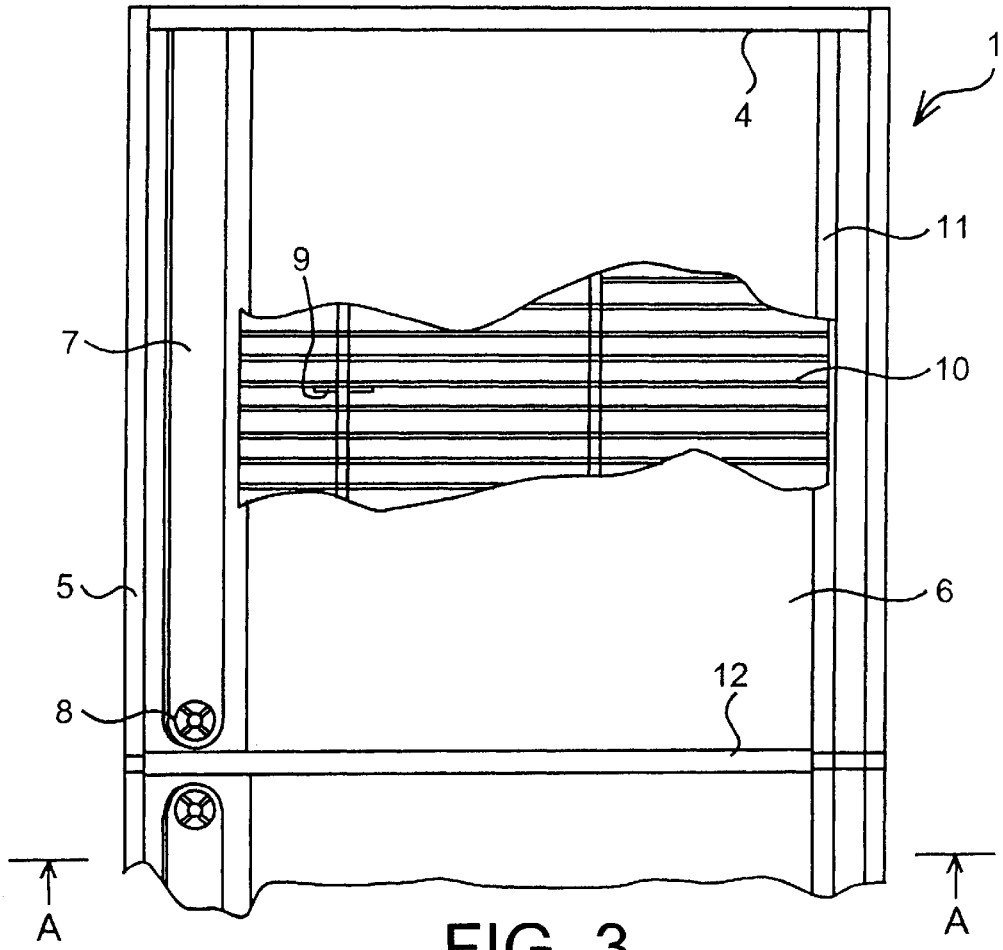
FIG. 3 is a plan view of the urinal channel, sub-floor and grid of FIG. 1.
Figure 4:
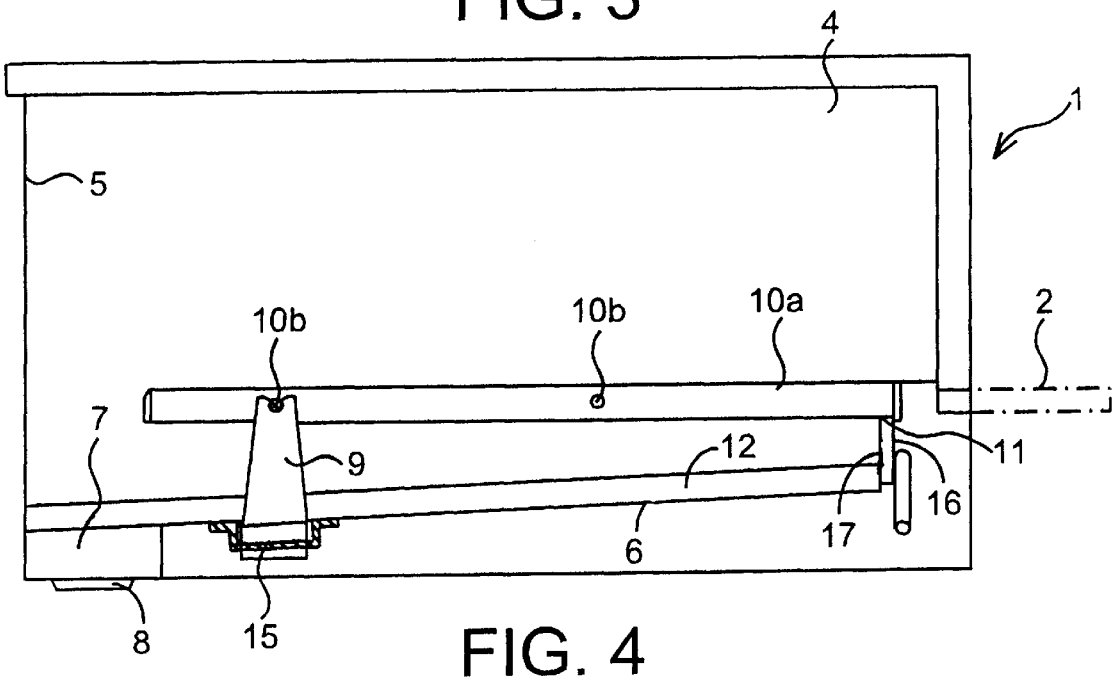
FIG. 4 is a sectional elevation of the urinal channel, sub-floor and grid of FIG. 1.

Referring especially to FIGS. 2 and 4, the flushing means comprises a water passage 16 or fitting extending along the upper side of the inclined sub-floor 6. The passage 16 is provided with apertures 17 at regular intervals. The passage 16 is connected to the mains water supply (not shown) by plumbing connections (not shown). A detector may be provided for identifying the presence of a person. Detectors, for example photoelectric detectors, are already known for triggering automatic flushing of urinals and conveniently a single detector of this type may be used to trigger flushing of the urinal wall and the sub-floor 6. In response to the presence of a person a valve (not shown) opens to allow water from the mains to flow along the passage 16 and out through apertures 17. The passage 16 consists of a strip of sheet steel attached to the upwardly contoured lip of the sub-floor 6. Alternatively flushing may be carried out intermittently on an automatic basis by means of a conventional flushing system which is tripped when a cistern fills. Flushing may be carried out with disinfectant or perfumed water. The combined urinal channel 7, sub-floor 6 and floor may easily be installed in new or existing lavatories, no special plumbing or drainage requirements are necessary.

Figure 5:
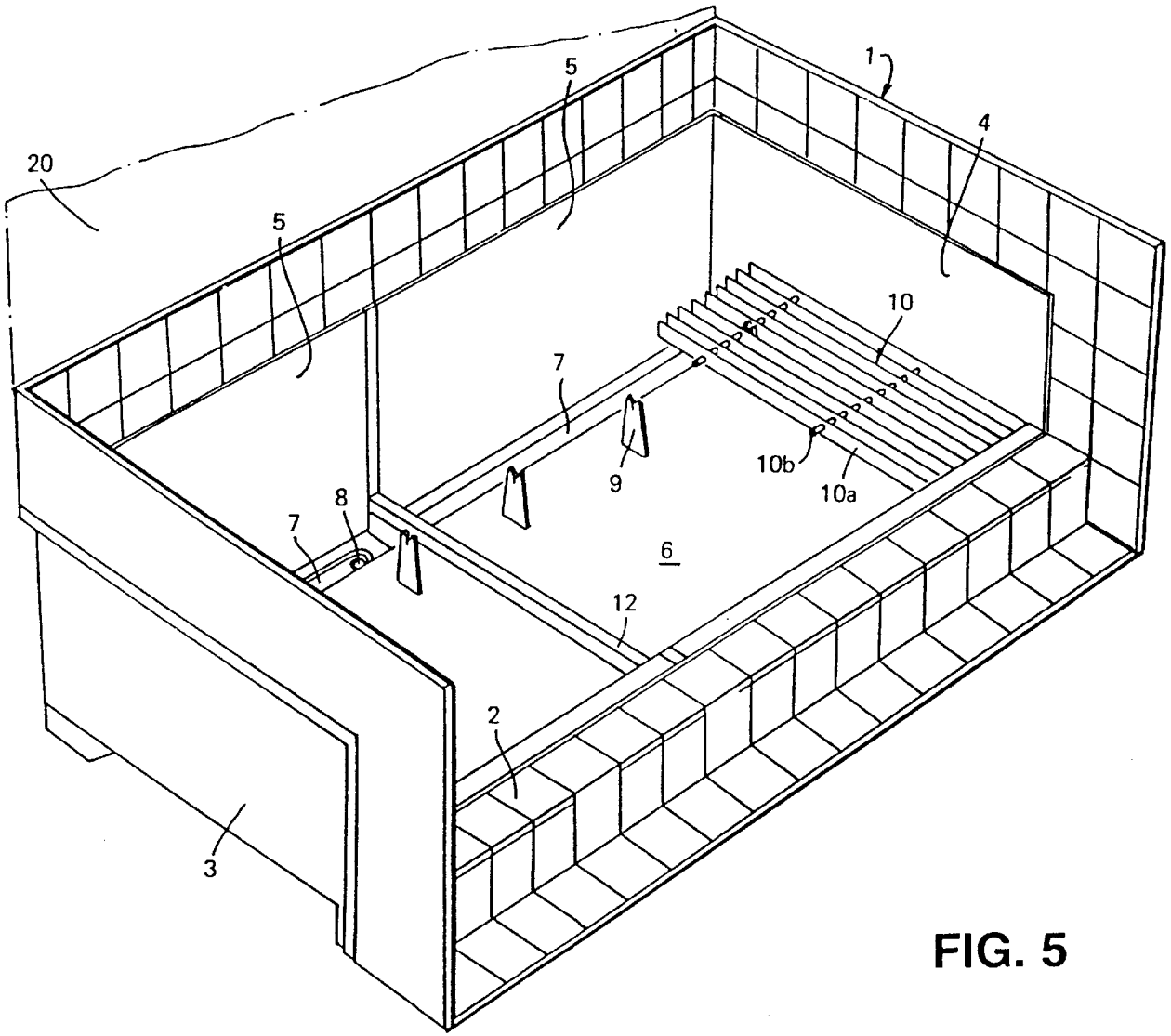
FIG. 5 is a view similar to FIG. 1 but showing a urinal channel, sub-floor and grid according to the invention in the form of a unit for installation in an existing building.
Figure 6:
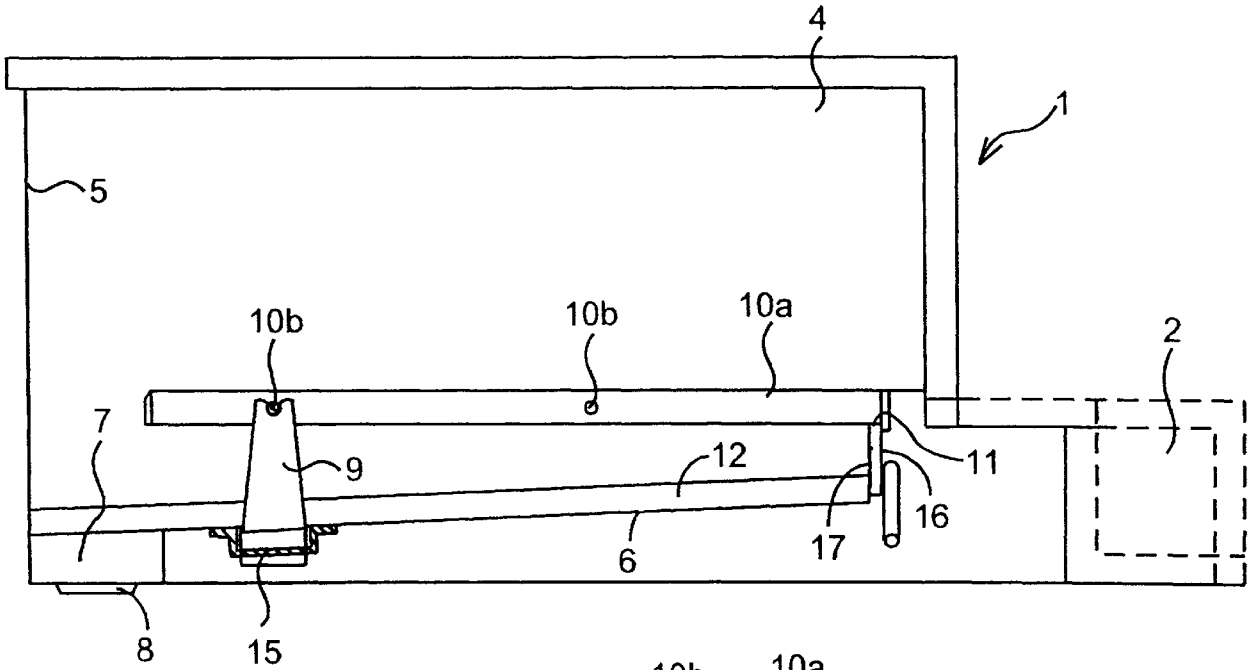
FIG. 6 is a sectional elevation of the urinal channel, sub-floor and grid of FIG. 5.

Referring now to the combined urinal channel, sub-floor and floor shown in FIGS. 5 and 6, the only difference from the combination shown in FIGS. 1 to 4 is that the combined urinal channel, sub-floor and floor is intended to be installed in an existing building and for this purpose includes a step 2 at the front thereof so that the grid 10 is at a level one step higher than floor level and the sub-floor 6 is at or just slightly above the floor level. In contrast, in the combined urinal channel, sub-floor and floor element shown in FIGS. 1 to 4, the grid 10 is at the same level as the floor, the sub-floor 6 is at a lower level than the floor, and for certain types of floor it may be possible to incorporate the urinal channel, sub-floor and floor into the building in such a way that when the floor is washed, for example by hosing with water, drainage takes place towards and onto the sub-floor.

Figure 7:
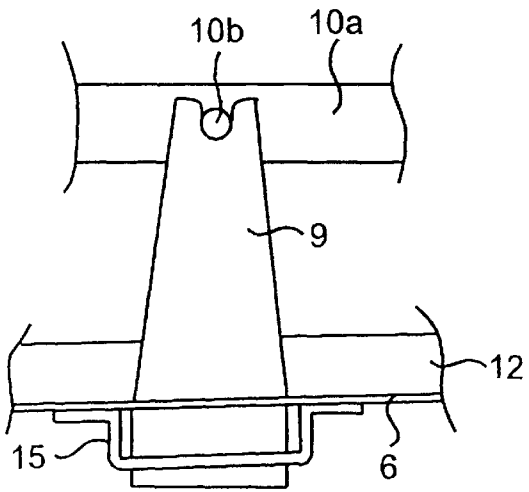
FIG. 7 is an elevation of a typical support member for the grid floor of both FIG. 1 and FIG. 5.

Referring now to FIG. 7, this shows the support arrangement for the mounting stanchions 9 in greater detail.

The urinal channel sub-floor and floor is composed of standard, stainless steel modules which may be assembled on site. Each module is approximately 700 mm wide and 700 mm deep overall from front to back. Standard modules (that is where vitreous china or other urinal pans are provided, not shown in the drawings) are approximately 400 mm high overall, from the bottom of the drainage channel to the top of the skirting. Facilities for joining the units together are built into each module. Left and right hand end modules are also provided. In each 700 mm wide module the grid 10 is designed in such a way that only about 20% of its surface is solid. In addition the top surface of each 3 mm wide parallel member 10*a* is rounded, to further reduce the area on which moisture can lodge. The remaining 80% of the surface of the grid 10 is made up of a series of voids through which fluids can pass.

A minimum of two modules—1400 mm wide (4'8" approximately) rising in multiples of 700 mm is the most economical in the use of material, but minor variations to the standard allow for virtually complete flexibility.

The drawings show a combined channel, urinal sub-floor and floor for a new building (FIGS. 1 to 4 and 7) and an existing building (FIGS. 5 and 6 and 7). As previously mentioned a urinal wall is provided directly above the facing wall 5 of the urinal channel. In an alternative construction (not shown) a stainless steel urinal wall may be incorporated into or may form a part of the combination of the invention.

In an alternative construction, not shown, the "grid" consists of a sheet perforated with square or round holes.

In an alternative construction, not shown, wall mounted urinal pans are located directly above the channel 7 and drain down into the channel 7.

In an alternative construction, not shown, the channel 7 is inclined towards the gulley trap 8 to facilitate drainage.

What is claimed is:

1. A floor or floor element for use in a male toilet, comprising:

a facing wall which a person faces when urinating;

a grid on which a person may stand but through which fluid may pass downwardly, the grid comprising an array of parallel slats joined by transverse rods, a top surface of each parallel slat being rounded;

an inclined sub-floor onto which a fluid falls, the sub-floor sloping downwardly towards the facing wall;

mounting means for mounting the grid in a horizontal operational position above the inclined sub-floor;

a channel along a base of the facing wall and a drain outlet in the channel for draining the sub-floor; and flushing means along an upper side of the inclined sub-floor for flushing the sub-floor along a downward slope to the channel.

2. A floor or floor element for use in a male toilet, comprising:

a facing wall which a person faces when urinating;

a grid on which a person may stand but through which fluid may pass downwardly, said grid comprising essentially an array of parallel members extending towards the facing wall, the top surface of each parallel member being rounded;

an inclined sub-floor onto which a fluid falls, the sub-floor sloping downwardly towards the facing wall;

mounting means for mounting the grid in a horizontal operational position above the inclined sub-floor;

a channel along a base of the facing wall and a drain outlet in the channel for draining the sub-floor; and flushing means along an upper side of the inclined sub-floor for flushing the sub-floor along a downward slope to the channel.

3. A floor or floor element according to claim 2 wherein the grid is pivotally moveable between a horizontal operational position and a non-horizontal position and/or is removable to facilitate maintenance and/or washing.

4. A floor or floor element according to claim 2 in which the flushing means consists of a channel or pipe incorporated into and extending along at least a portion of the perimeter of the sub-floor and including a plurality of ports for delivering water to the sub-floor.

5. A floor or floor element within the vicinity of a urinal comprising:

a grid on which a person may stand but through which fluid may pass downwardly;

a sub-floor onto which the fluid falls;

mounting means for mounting the grid in a horizontal operational position above the sub-floor;

flushing means extending along an upper perimeter of the sub-floor for flushing the sub-floor, said flushing means including a water passage between the sub-floor and the grid, said water passage having plurality of ports for delivering water to an upper edge of the sub-floor, wherein the ports are apertures in a wall of the water passage and an are at a level higher than said upper edge; and a drain outlet for draining the sub-floor, wherein the floor element extends as far as the urinal;

the sub-floor is inclined downwardly towards the urinal;

the flushing means flushes down the inclined sub-floor towards the urinal; and the drain outlet is at a lower edge of the inclined sub-floor.

6. A floor or floor element within the vicinity of a urinal and extending as far as the urinal, comprising:

a facing wall which a person faces when urinating;

a grid on which a person may stand but through which fluid may pass downwardly;

an inclined sub-floor under the grid that slopes downward towards the facing wall;

a channel and drain outlet at a lower edge of the inclined sub-floor for draining the sub-floor, the channel extending along the base of the facing wall; and flushing means extending along the upper perimeter of the inclined sub-floor for flushing the sub-floor, said flushing means including a water passage between the sub-floor and the grid, said water passage having a plurality of ports for delivering water to an upper edge of the inclined sub-floor, wherein the ports are apertures in a wall of the water passage and are at a level higher than said upper edge; and means for mounting to permit mounting of the grid in a horizontal operational position above the inclined sub-floor so that fluid passing through the grid falls onto the inclined sub-floor and is flushed down the inclined sub-floor towards the channel at the base of the facing wall.

7. A floor or floor element according to claim 6 in which the grid, is movable pivotally between the horizontal operational position and a non-horizontal position to facilitate maintenance and/or washing.

8. A floor or floor element according to claim 7 wherein the grid, is mountable so that a front edge, which is the edge remote from the facing wall, is pivotable upwardly.

9. A floor element according to claim 8 wherein the floor element further comprises a plurality of modules made of stainless steel.

10. A floor or floor element according to claim 7 in which the mounting means include pillars and the grids mesh or array being pivotally mounted on the pillars so as to be moveable between the horizontal operational position and a non-horizontal position.

11. A floor or floor element according to claim 6 wherein the channel is inclined towards the drain outlet.

12. A floor or floor element according to claim 6 provided in the form of a plurality of modules for assembly on site in a building.

13. A floor element according to claim 12 further comprising means for joining two modules along a common edge.

14. A floor or floor element according to claim 6, wherein said grid, is detachable from a horizontal operational position to facilitate maintenance and/or washing.

15. A floor or floor element according to claim 6 wherein the grid is designed in such a way that only about 20% of its surface is solid and about 80% of the surface of the grid is made up of a series of voids through which fluids can pass.

* * * * *

UNITED STATES PATENT AND TRADEMARK OFFICE

CERTIFICATE OF CORRECTION

PATENT NO. : 6,141,803
DATED : November 7, 2000
INVENTOR(S) : Thomas Austin Dunphy et al.

It is certified that error appears in the above-identified patent and that said Letters Patent is hereby corrected as shown below:

Column 8, claim 10,
Line 2, delete "mesh or",
Line 3, delete "array".

Figure 8:
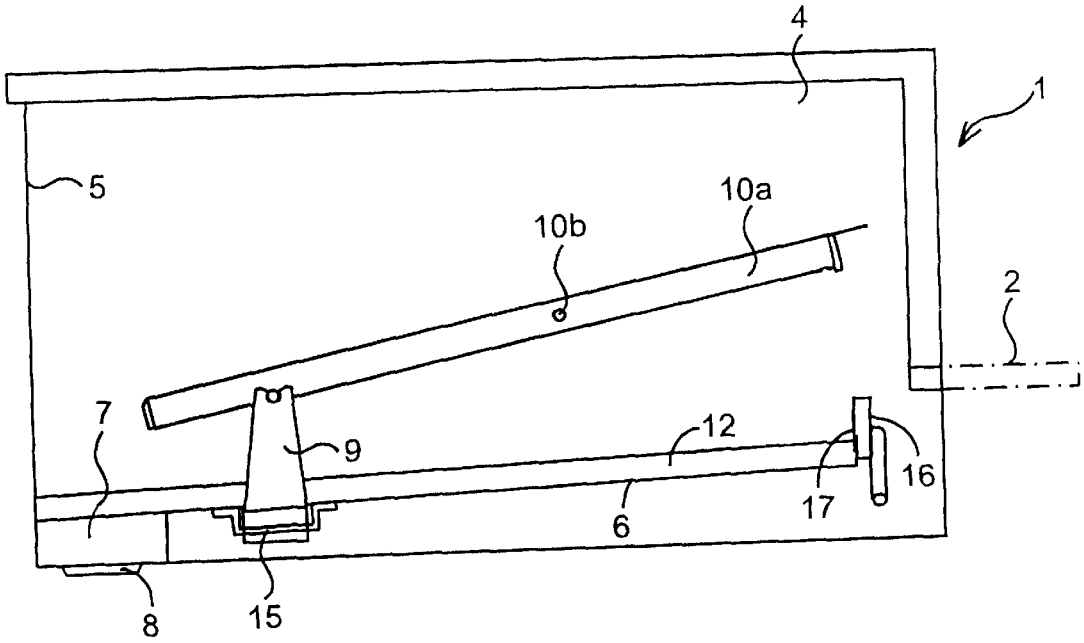
FIG. 8 shows the grid of FIG. 4 in a raised position.

The drawings consisting of Figs. 4, 6 and 8, should be deleted to be replaced with the drawings, consisting of Figs. 4, 6 and 8, as shown on the attached pages.

Fig. 4 should read as follows:

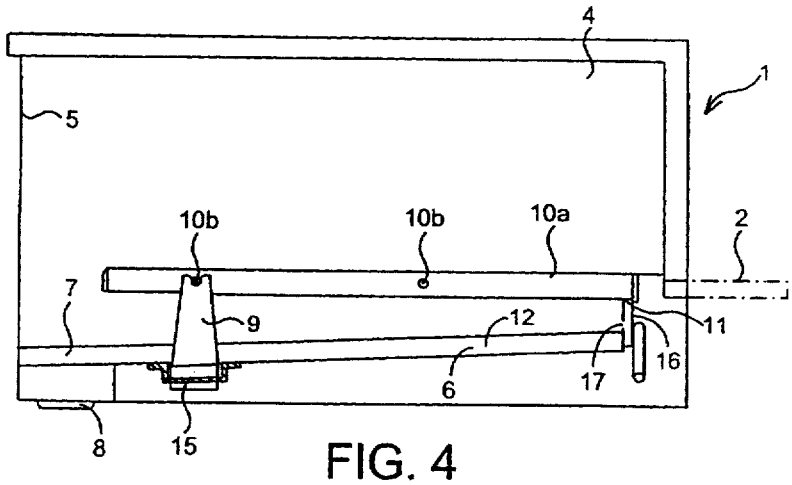

FIG. 4

Fig. 6 should read as follows:

FIG. 6

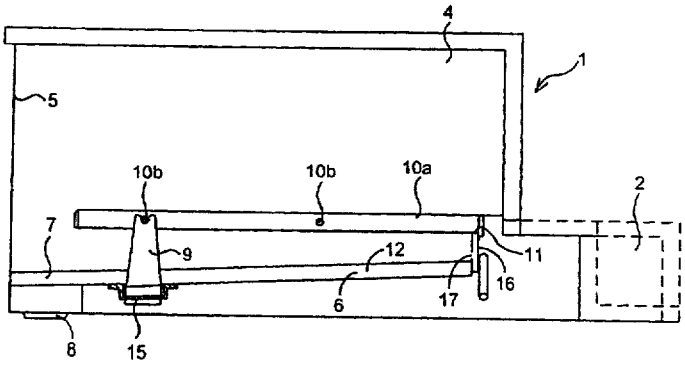

UNITED STATES PATENT AND TRADEMARK OFFICE

CERTIFICATE OF CORRECTION

PATENT NO. : 6,141,803
DATED : November 7, 2000
INVENTOR(S) : Thomas Austin Dunphy et al.

It is certified that error appears in the above-identified patent and that said Letters Patent is hereby corrected as shown below:

Fig. 8 should read as follows:

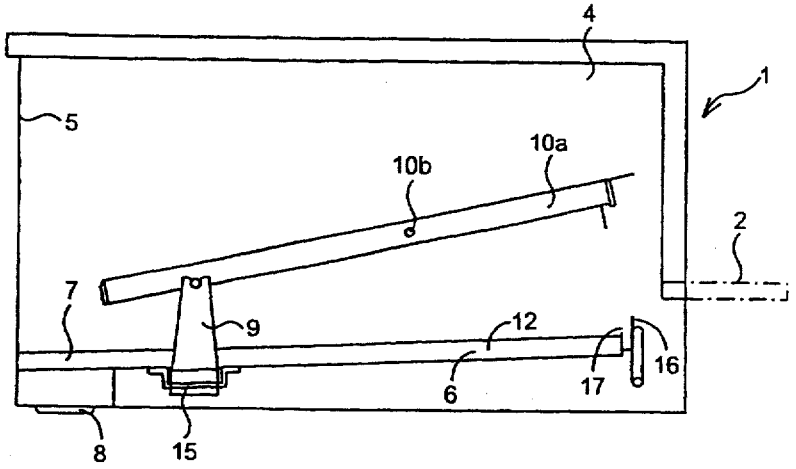

FIG. 8

Signed and Sealed this

Twenty-ninth Day of January, 2002

*Attest:*

*Attesting Officer*

JAMES E. ROGAN
*Director of the United States Patent and Trademark Office*